US006652425B1

(12) United States Patent
Martin et al.

(10) Patent No.: US 6,652,425 B1
(45) Date of Patent: Nov. 25, 2003

(54) CYCLOCENTRIC ERGOMETER

(75) Inventors: Matthew R. Martin, Remsenberg, NY (US); Edward Behan, Blue Point, NY (US); David A. Brown, Evanston, IL (US)

(73) Assignee: Biodex Medical Systems, Inc., Shirley, NY (US)

( * ) Notice: Subject to any disclaimer, the term of this patent is extended or adjusted under 35 U.S.C. 154(b) by 0 days.

(21) Appl. No.: 10/160,487

(22) Filed: May 31, 2002

(51) Int. Cl.[7] ..... A63B 22/06; A63B 21/16
(52) U.S. Cl. ..... 482/57; 482/123
(58) Field of Search ..... 482/96, 130, 72, 482/121–123, 135, 142, 57–63, 51, 73

(56) References Cited

U.S. PATENT DOCUMENTS 4,798,378 A * 1/1989 Jones ..... 482/72
5,732,964 A * 3/1998 Durham et al. ..... 280/266
6,238,322 B1 * 5/2001 Hsu ..... 482/96

* cited by examiner

*Primary Examiner*—Stephen R. Crow
(74) *Attorney, Agent, or Firm*—Gibbons, Del Deo, Dolan, Griffinger & Vecchione

(57) ABSTRACT

A cyclocentric ergometer and method in which a relative position of a seat on a seat slide rack is adjusted, a load is applied on the seat slide rack with elastic cords to confine back and forth movement of the seat slide rack to within a range, and a user sits on the seat and pedals while the load is applied. The seat and seat slide rack move in unison together.

44 Claims, 11 Drawing Sheets

CYCLOCENTRIC ERGOMETER

BACKGROUND OF THE INVENTION

Field of the Invention

This invention pertains to an exercise device such as a cyclocentric ergometer, but that uses elastic cords to apply force to the exercise device. The specific force applied is achieved by adjusting the length of the cords and/or by varying the number of cords that are used to exert the force. The instant invention also provides an improved method to effectively and safely vary the force exerted on an exercise device using cords.

It is known that when a patient is in the rehabilitation stage of recovering from a stroke, the patient is often too weak to stand even when being assisted. Studies have shown that training a patient to support a fractional load of one's body weight while safely seated and moving his legs in a cyclic motion is beneficial for building limb strength and for increasing limb motion coordination. Thereafter, a patient can begin to embark on assisted ambulatory efforts.

There are other key advantages to a cyclocentric ergometer, such as, toning the quadriceps muscles through constant tension load pushing towards the pedals. Pulling the patient away from the pedals causes a similar loading pattern for the hamstring muscles.

Gravity is used to create a force to apply a free rolling seat or platform to move towards or away from the pedals or arm cranks of an exercise device. This has been done by mounting the seat or platform on an inclinable track that may be set at different angles. The track uses gravity and the body weight of the user to create the force. This method, however, has limitations particularly at higher loads and steep angles.

Although, cords, specifically elastic cords, have been used to create forces for exercise equipment, such uses have been primarily directed at applying such forces to resist linear repetitions or muscle contractions similar to the manner in which weights are used in selectorized weight equipment.

What is needed is an ergometer that uses a practical system to apply force using elastic cords on the ergometer and a practical method to do this effectively and safely.

What is further needed is an ergometer in which a patient can vary the force applied by varying the length of the cord(s) and/or changing the number of cords used to apply the force.

What is also needed is an improved method for applying force to an ergometer using elastic cords.

What is also needed is an improved ergometer and, more specifically, a semi recumbent ergometer that is configured with the exercise device of the present invention.

SUMMARY OF THE INVENTION

One aspect of the invention resides in a cyclocentric ergometer and method of using it. The method includes adjusting a relative position of a seat on a seat slide rack of the cyclocentric ergometer, setting and applying a load on the seat slide rack with elastic cords that confine back and forth movement of the seat slide rack to within a range, and pedaling while sitting on the seat with the load applied.

DETAILED DESCRIPTION OF THE INVENTION

Figure 1:
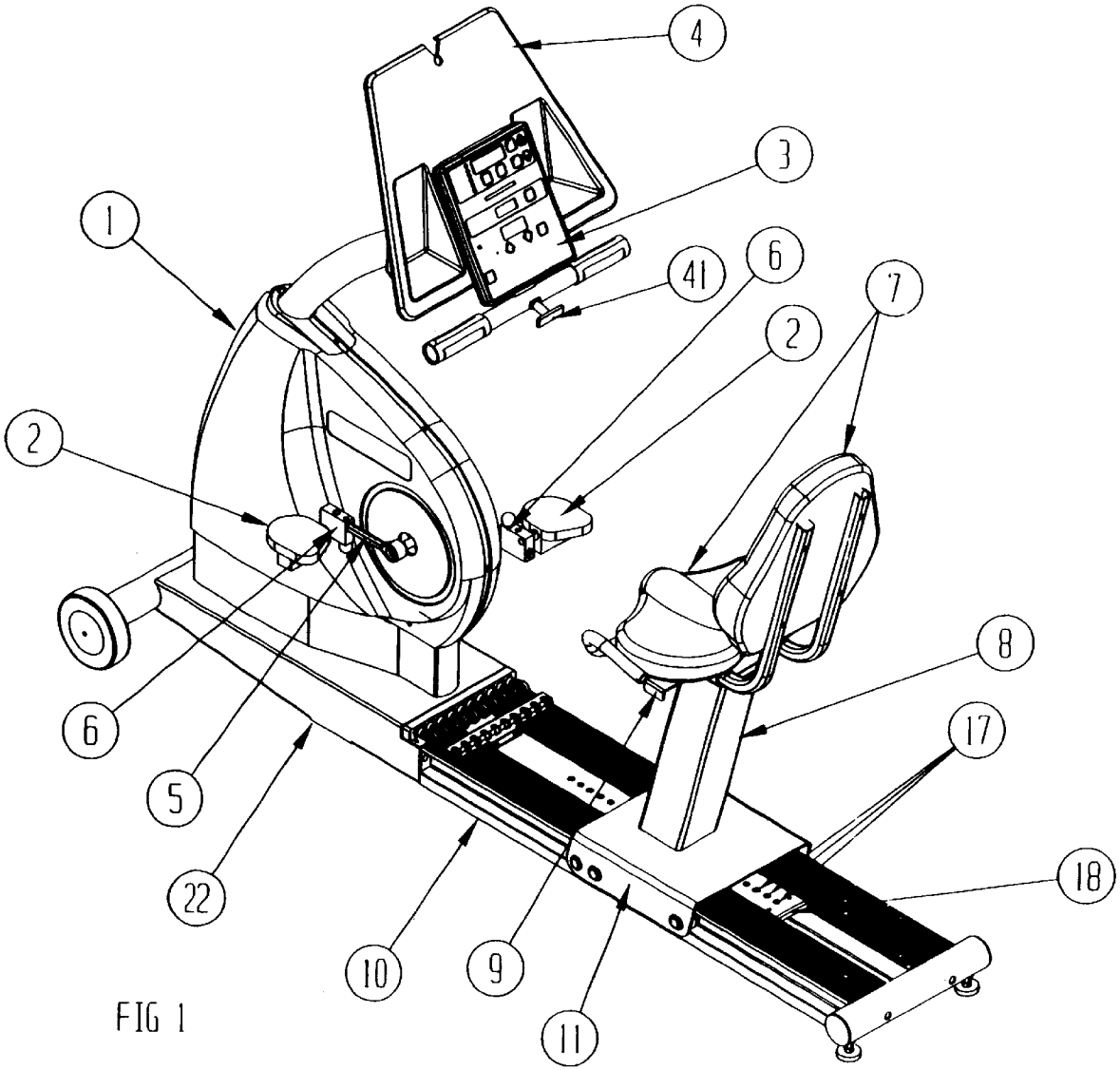
FIG. 1 is a perspective view of the exercise device of the present invention.

Turning to FIG. 1, the exercise device 1 of the present invention comprises a semi recumbent ergometer. In a preferred embodiment, the exercise device 1 is configured with a plurality of pedals 2, a controller display 3 and a magazine/water bottle holder 4. Resistance to rotation is provided at the pedals 2 through means known to one skilled in the art, such as, via friction or via the electrotechnical resistance of an alternator. In a preferred embodiment, the exercise device is configured with adjustable pedal cranks 5, such that the length of the pedal cranks 5 can be changed by altering the location of each pedal housing 6 corresponding to each of the pedal cranks 5. Each of the pedal housings 6 may be slid into various positions along the pedal cranks 5 and then each of the pedal housings can be locked into a preferred position.

Figure 2:
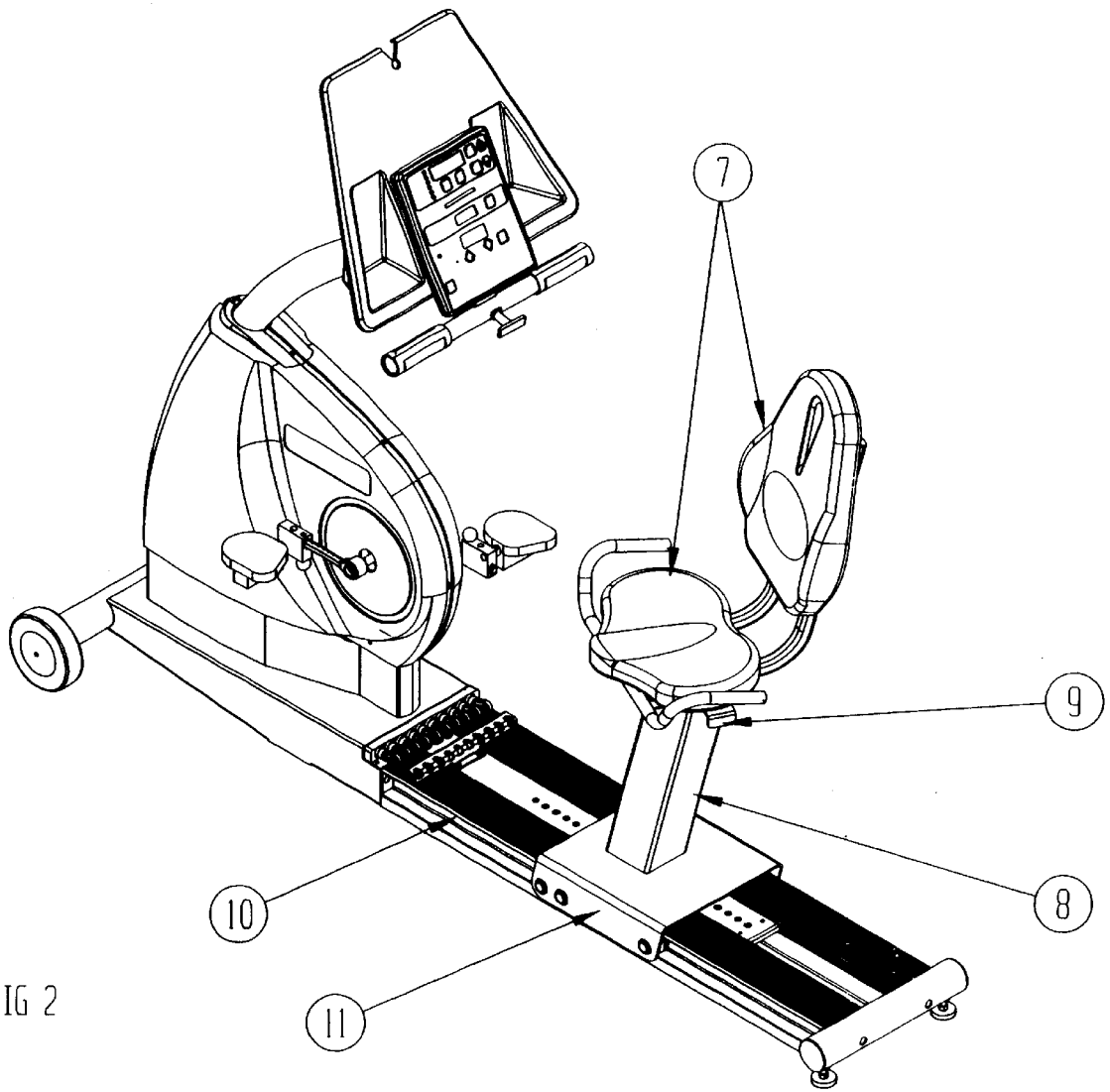
FIG. 2 is a perspective view of the exercise device of FIG. 1, but with the seat partially rotated.

Turning to FIG. 2, a seat 7 is rotatably mounted to a seat pedestal 8. The seat unit 7 may be unlocked by pulling a locking handle 9 and rotating the seat 7 around an axis of the seat pedestal 8. The seat unit 7 may be locked at various positions to allow easy access for injured or disabled patients. The exercise device is configured with a base 10 that is relatively low in height. The low height of the base 10 allows a patient to easily swing his or her leg over to an opposite side.

Figure 3:
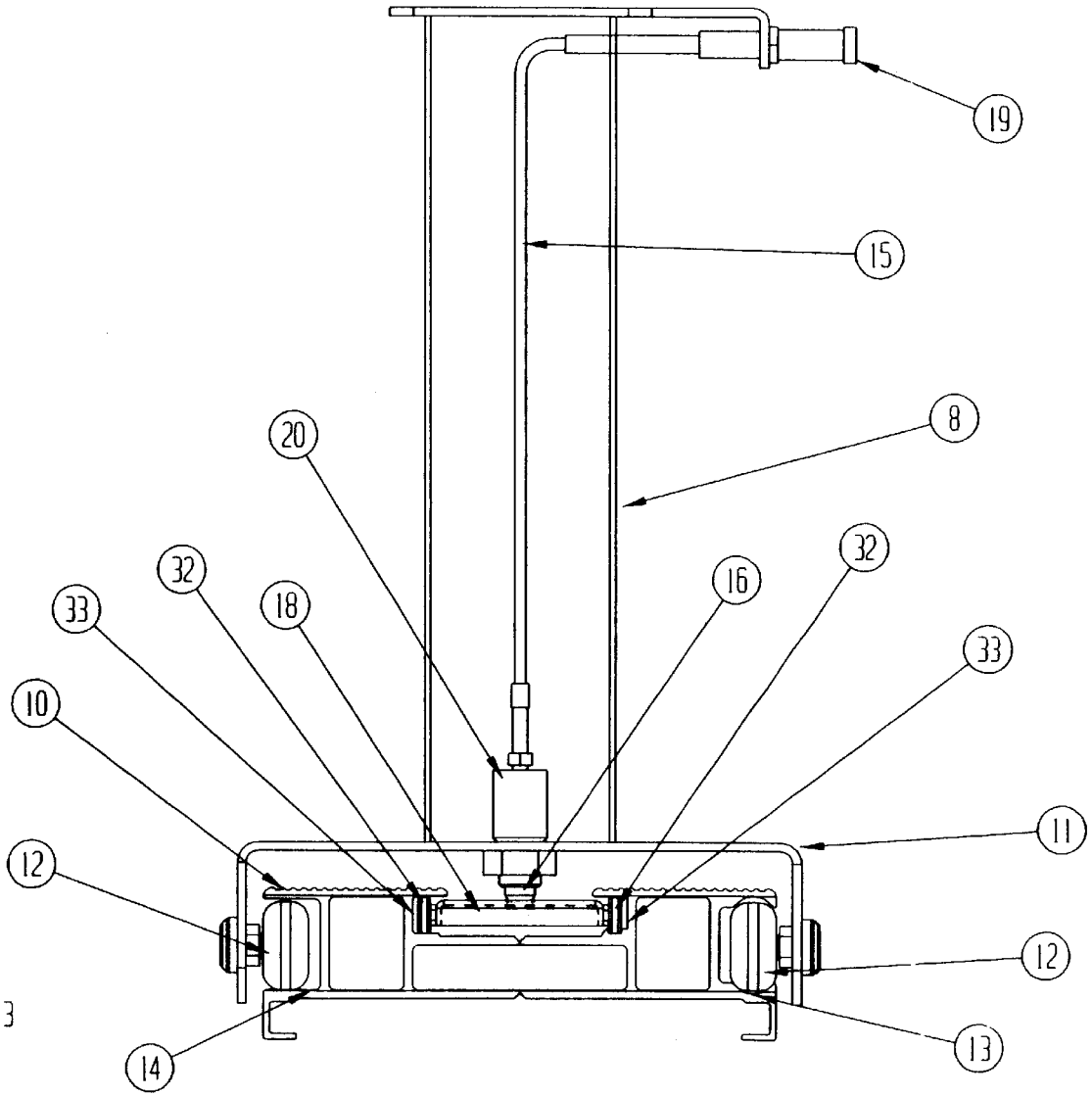
FIG. 3 is a cutaway view of the rear of the exercise device of the present invention showing the base and rolling seat platform.

As shown in FIG. 3, the seat pedestal 8 is fixed to a rolling platform 11. The rolling platform 11 has three wheels or more 12 mounted to each of the two sides roll slide along the base 10. The wheels 12 run in right and left channels 13,14 within the base 10. The wheels 12 are generally constructed of molded plastic and contain ball bearings to reduce friction. A center wheel on each side of the rolling platform 11 is mounted on an eccentric shaft (not shown) so that the rolling platform 11 can be adjusted upwards to take the play out of the rolling platform 11. The base 10 is preferably constructed from extruded aluminum and welded to conform to the shape of the channels 13, 14. The right channel 13 is designed with a rounded portion to capture the wheels 12 on the right side of the platform 11. The left channel 14 is straight to allow the wheels 12 on the left side of the base 10 to float and, thereby, make up for any differences in tolerances in the assembly of the exercise device 1.

The rolling platform 11 is locked in place using a control cable 15 and a pull pin 16. The pull pin 16 engages holes 17 in a seat slide rack 18. To adjust the seat 7 to a different position, the user pulls a seat release handle 19 which pulls a control cable 15 that in turn pulls the pull pin 16 out of the hole 17 it had previously been in. As a result, the rolling platform 11 is now free to move into another position. When the seat release handle 19 is released, a spring (not shown) within the seat lock housing 20 pushes the pull pin 16 back into the hole 17.

Figure 4:
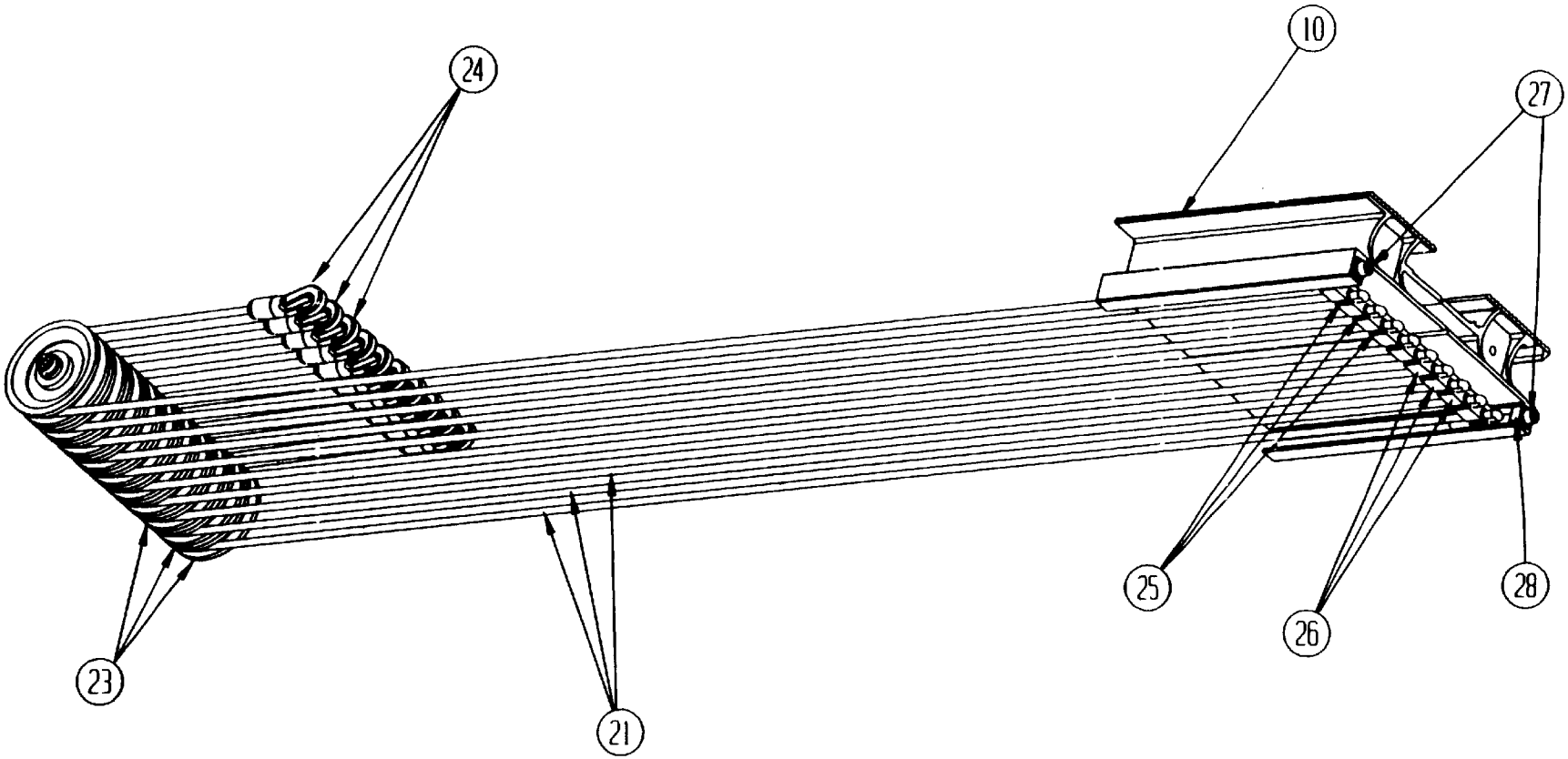
FIG. 4 is a perspective view of the underside of the exercise device of the present invention showing only a cord and pulley assembly.

Turning to FIG. 4, a plurality of elastic cords 21 are positioned beneath the base 10 and within the frame 22. Each of the elastic cords 21 is configured with wrap around pulleys 23. A common spindle passes through the center of each of the pulleys 23 and is secured to side walls of the frame 22. The pulleys 23 may freely rotate about the spindle. Each of the elastic cords have two ends, one of the ends of each elastic cord terminates on a hook 24. The other end of the elastic cord 21 is fixed in a slot 25 in an adjusting rack 26. The diameter, design and stretch length of the elastic cords 21 determine the force applied to the exercise device 1. Each elastic cord 21 may apply ten (10) lbs. of pressure when stretched out to its operating length. This force can be adjusted to an extent by adjusting the stretched length of the elastic cords as a group, i.e., by adjusting the position of the adjusting rack 26. The adjusting rack 26 contains tapped holes and jack screws 27 that are rotatably mounted to lock blocks 28 in the base 10. The jack screws 27 are threaded into the tapped holes in the adjustment rack 26. It can be appreciated. that turning the jack screws 27 moves the adjusting rack 26, thereby, adjusting the stretch of the elastic cords 21. Thus, if there are differences in the tension being applied by each of the elastic cords 21, the jack screws 27 may be turned to adjust the tension of the group of cords.

Figure 5:
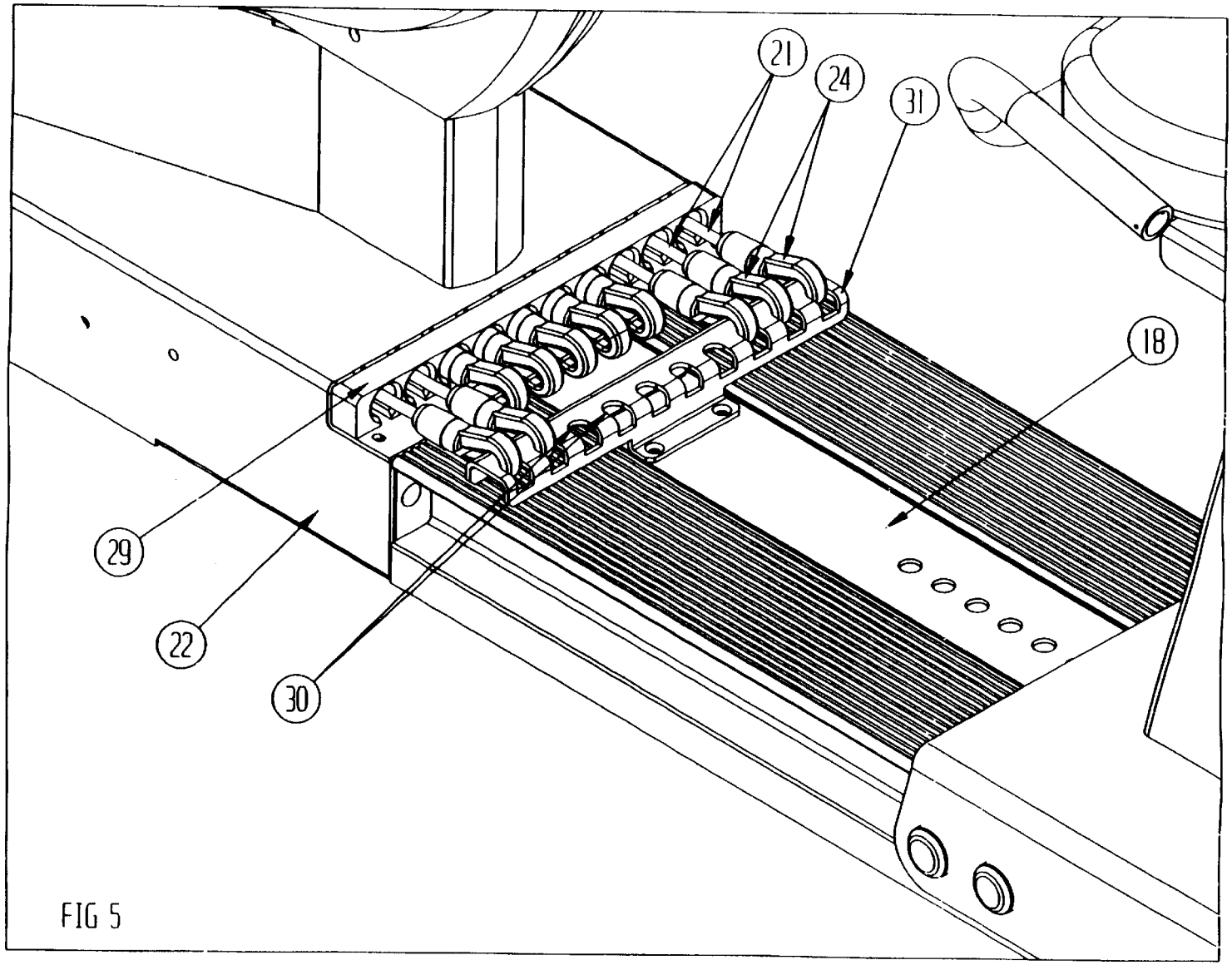
FIG. 5 is a perspective view of the exercise device of the present invention showing only the cord and pulley assembly together with a mounting bracket.

Turning to FIG. 5, hooks 24 rest in receptacles in a stop block 29 that is mounted to the frame 22. The stop block 29 is preferably molded out of smooth plastic to prevent abrasion to the elastic cords 21. To apply a load to the seat unit 7, the user selects the number of elastic cords 21 to use. For example, if a user opts to apply a force of fifty (50) lbs., he would select five elastic cords 21. Because each elastic cord 21 exerts ten (10) lbs. of force, in combination, five elastic cords 21 apply fifty (50) lbs of force. The actual application is performed by the user grasping the hooks 24 and pulling them out of the stop block 29. The hooks 24 are then placed into slots 30 in a hook mounting bracket 31. The hook mounting bracket 31 is fixed to a seat slide rack 18.

FIG. 3 shows the seat slide rack 18 has a roll free assembly in the base 10 which is comprised of a plurality of small plastic wheels 32 with ball bearings mounted to each side of the seat slide rack 18. The small wheels 32 run in extruded grooves 33 in the base 10. It can be seen that the seat 7 is locked to the seat slide rack 18 such that they will move synchronously. The seat slide rack 18 only allows for a limited motion of up to about six (6) inches along the seat slide rack 18. The seat slide rack 18 is locked in the forward most position so it will not slide back and forth in the base 10. The seat 7 is adjusted so that is no longer moves upon locking the seat slide rack 18. At this juncture, there is no load being applied to the seat 7 stemming from any elastic cord 21 via the seat slide rack 18.

Figure 6B:
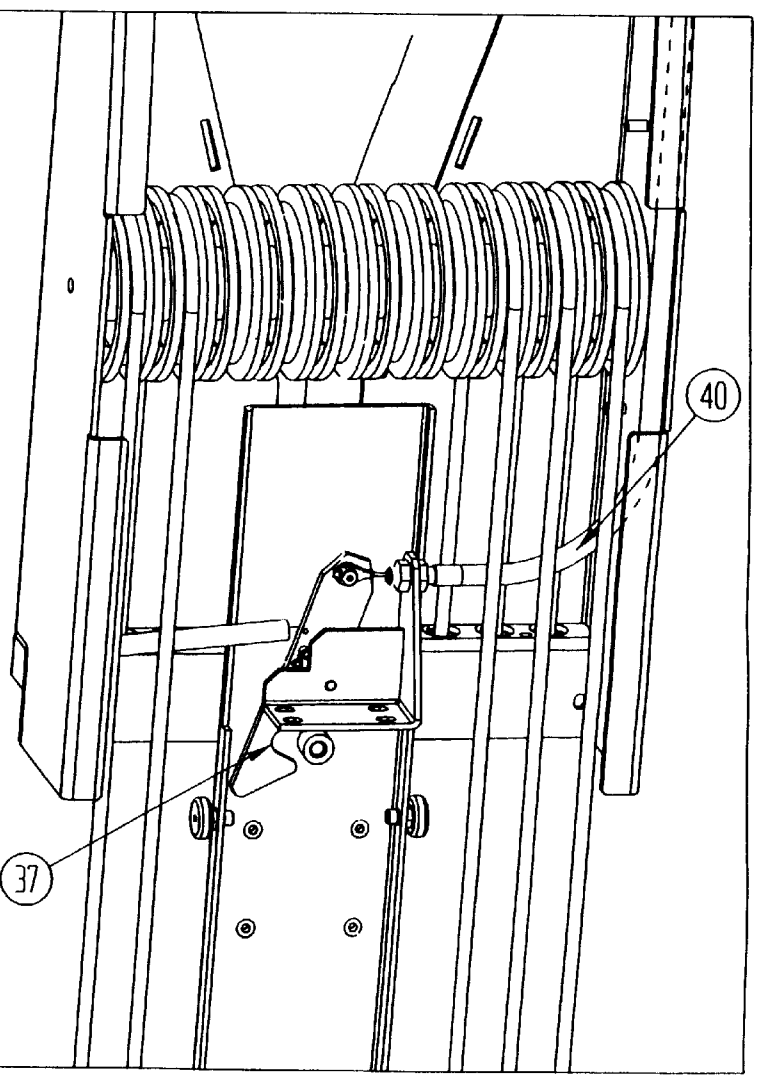
FIGS. 6*a* and 6*b* are respective perspective views of the exercise device of the present invention showing a portion of the underside of the exercise device with a pawl in locked and unlocked positions.
Figure 6A:
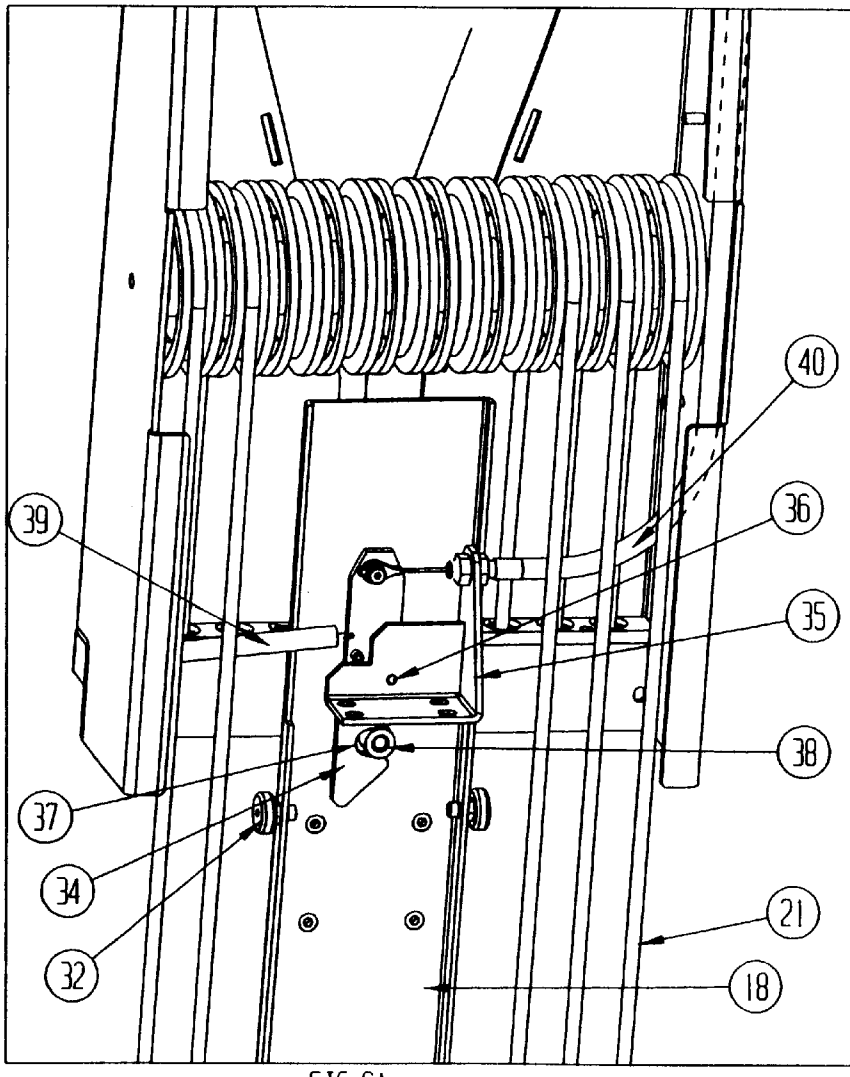

Turning to FIGS. 6*a* and 6*b*, the locking mechanism of the seat slide rack 18 is demonstrated. A pawl 34 is rotatably mounted to a lock bracket 35 via a pin 36. The lock bracket 35 is fixed to a section of the frame 22 not shown. It can be seen that the pawl 34 only rotates about the pin 36. A slot 37 in the pawl 34 engages a stud 38 that is attached to the seat slide rack 18. The pawl 34 is held in a locked position by an extension spring 39. FIG. 6*b* shows the pawl 34 in the release position. A seat slide rack release control cable 40 is rotatably attached to the end of the pawl 34 via a shoulder bolt (not shown). In operation, when the seat slide rack release handle 41 (FIG. 1) is pulled by the user, the control cable 40 pulls the end of the pawl 34 so the slot 37 pulls away from the stud 38, releasing the seat slide rack 18 from the frame 22. It can be seen that the seat 7 now freely rolls with the seat slide rack 18 in proportion to the motion of the seat side rack 18.

The load is safely applied to the seat unit 7 while pedaling the exercise device in accordance with the following method. A user sits on the seat unit 7 either by straddling the base 10 or by using the seat rotation feature. The user releases the seat unit 7 from the seat slide rack 18 by pulling the seat release handle 19 and moves the seat to a first position for comfortable pedaling. The user moves the seat 17 forward three holes 17, each hole 17 being spaced approximately one-inch apart from the previous hole 17 (three inches) and then releases the seat release handle 19 which locks the seat unit 7 in place. Now, the user is within reaching distance of the hooks 24 that are attached to the ends of the elastic cords 21. The user then selects the number of hooks 24 corresponding to the desired load, in this case, five hooks 24, and grasps the hooks 24 on the elastic cords 21 and places the hooks on the mounting bracket 31 (FIG. 5). The user then places his/her feet on the pedals 2, pulls the seat slide release handle 41 and pushes the seat unit 7 with the seat slide rack 18 back 3" to the preferred pedaling position. The user now holds the load from the elastic cords 21, which results from a tension force on the seat slide rack 18 which, in turn, exerts a second force on the seat unit 7. The user is in the middle part of the seat slide rack 18. If the user is unable to hold the load from the elastic cords 21, the seat unit 7 will move only three inches forward or if the user pushes too hard, the seat will only move three inches backwards. In this manner, the user is safely supporting the load.

Figure 9:
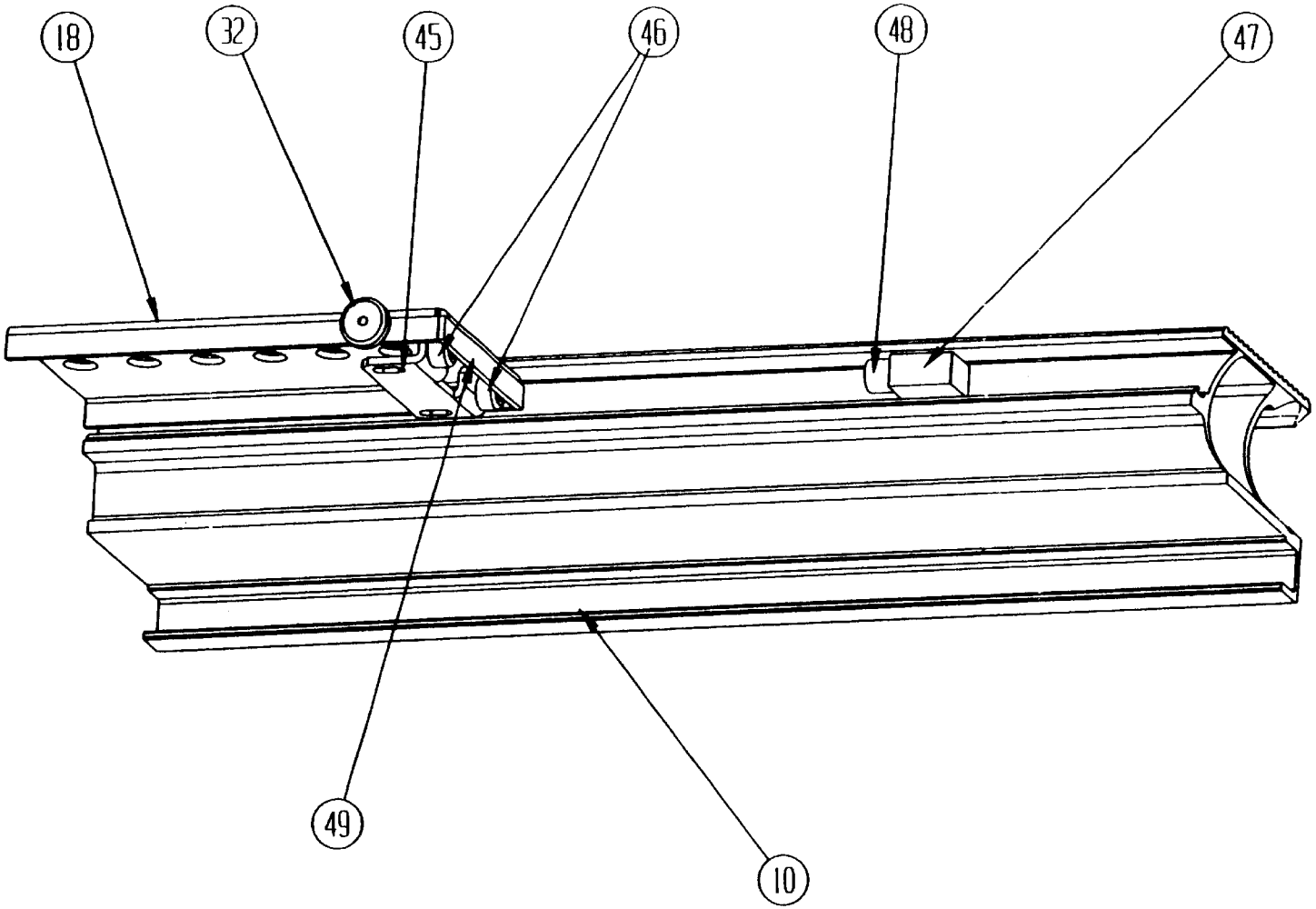
FIG. 9 is a partially broken perspective view of the base in accordance with the invention.

The seat slide rack 18 is limited in it's motion by stops. FIG. 9 is a partial cutaway view of the base. The seat slide rack 18 is shown in its forward most position, fixed by the locking mechanism (not shown). In this position, the rear end 49 of the seat slide rack 18 rests against front rubber bumpers 46. The bumpers are fixed to a front mounting bracket 45. The mounting bracket is attached to the extruded base 10. That part of the base 10 is cut away for clarity.

When the seat slide rack 18 is released from the locking mechanism, it can roll back supported by small plastic wheels 32 rolling in the grooves 33 in the base 10. The seat slide rack 18 is free to roll back until the rear end 49 it strikes the rear bumper 48 mounted in the rear stop block 47. There is another rear bumper and rear stop block mounted in the other groove in the other side of the base not shown. It can be seen that the motion of the seat slide rack is restricted by the front and rear rubber bumpers.

Figure 7:
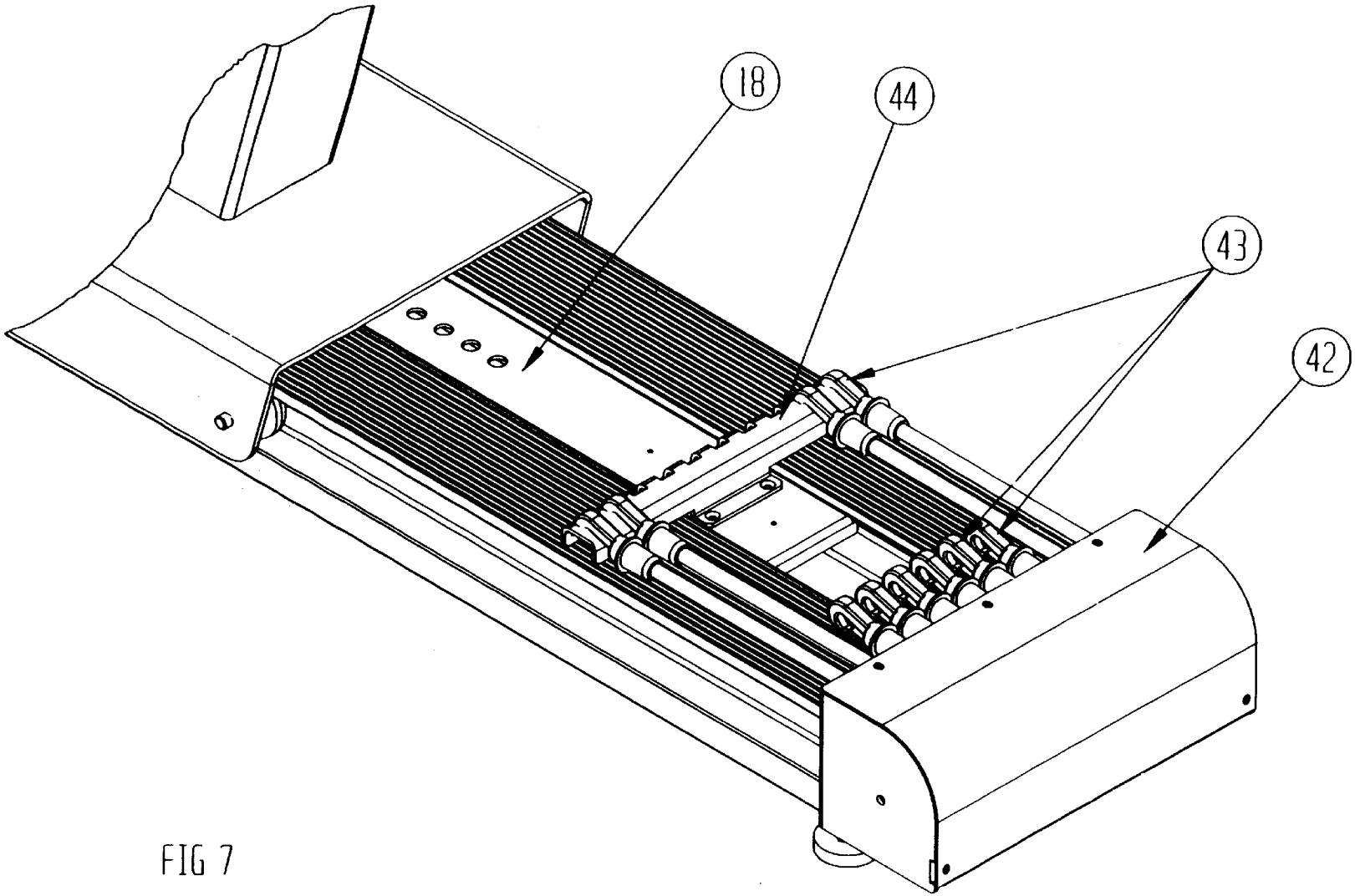
FIG. 7 is a partially broken perspective view of the rear portion of the exercise device of the present invention showing a rear cord and pulley assembly.

Turning to FIG. 7, the elastic cords 21 are shown extended into another position and wrapped around a second set of pulleys (not shown) under a cover 42 such that the elastic cords 21 extend out of a rear stop block and terminate on a second set of hooks 43. The elastic cords 21 may be attached to a rear hook mounting bracket 44, which is fixed to the seat slide bracket 18. In this way, loads can be applied to the seat 7 to pull it away from the pedals 2. If heavy loads are used in this way, belts may be required on the seat to hold the user in and special pedals may also be required to secure the users feet to the pedals.

Figure 8:
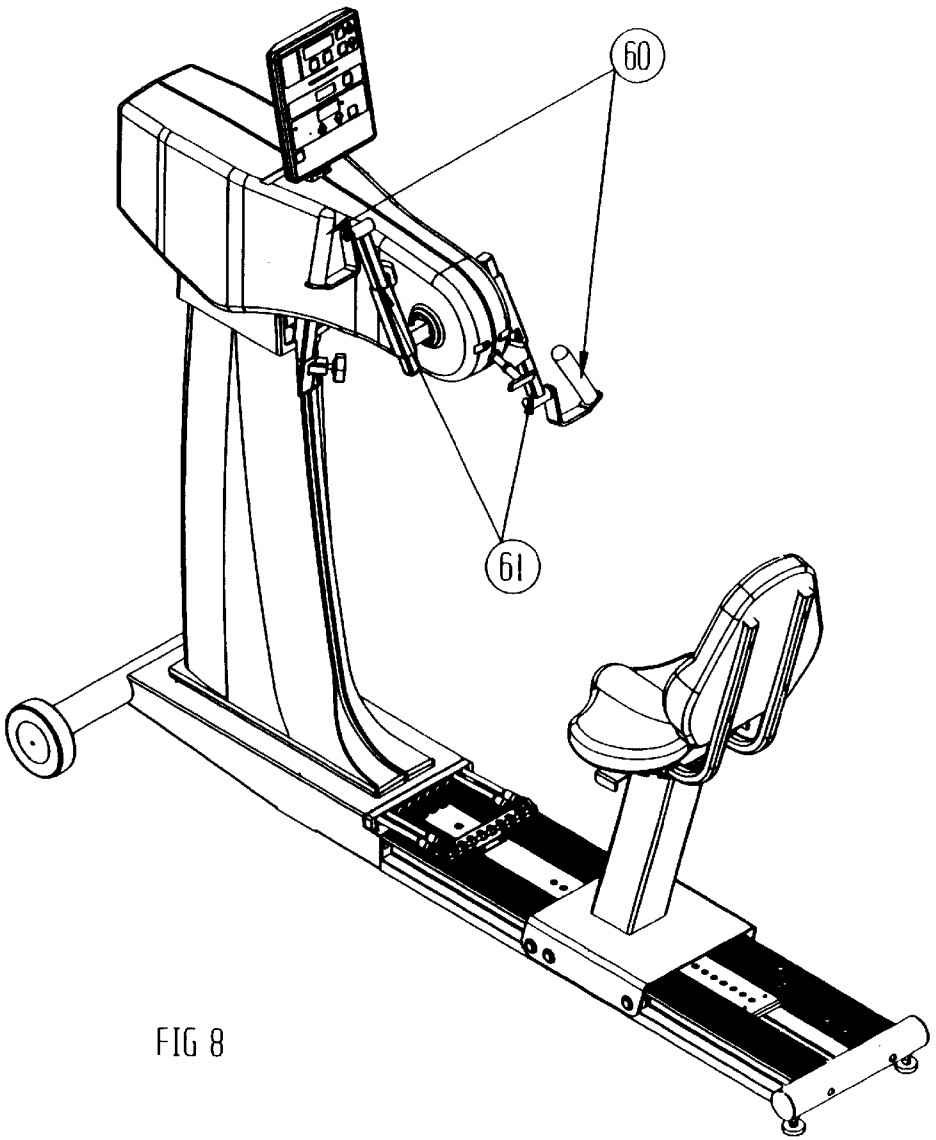
FIG. 8 is a perspective view of a further embodiment of the exercise device of the present invention.

Turning to FIG. 8, another embodiment of the present invention is shown for an upper body ergometer. The rotating seat and rear elastic cords operate in the same manner as was the case for the lower body ergometer of FIGS. 1–7.

The difference between the upper body ergometer and the lower body ergometer is, as best seen by comparing FIGS. 1 and 8, that the leg pedals 2 and leg pedal cranks 5 are replaced by arm pedals 60 and arm grip cranks 52 that are at a higher elevation than was the case for the leg pedals 2 and leg pedal cranks 5.

Figure 10:
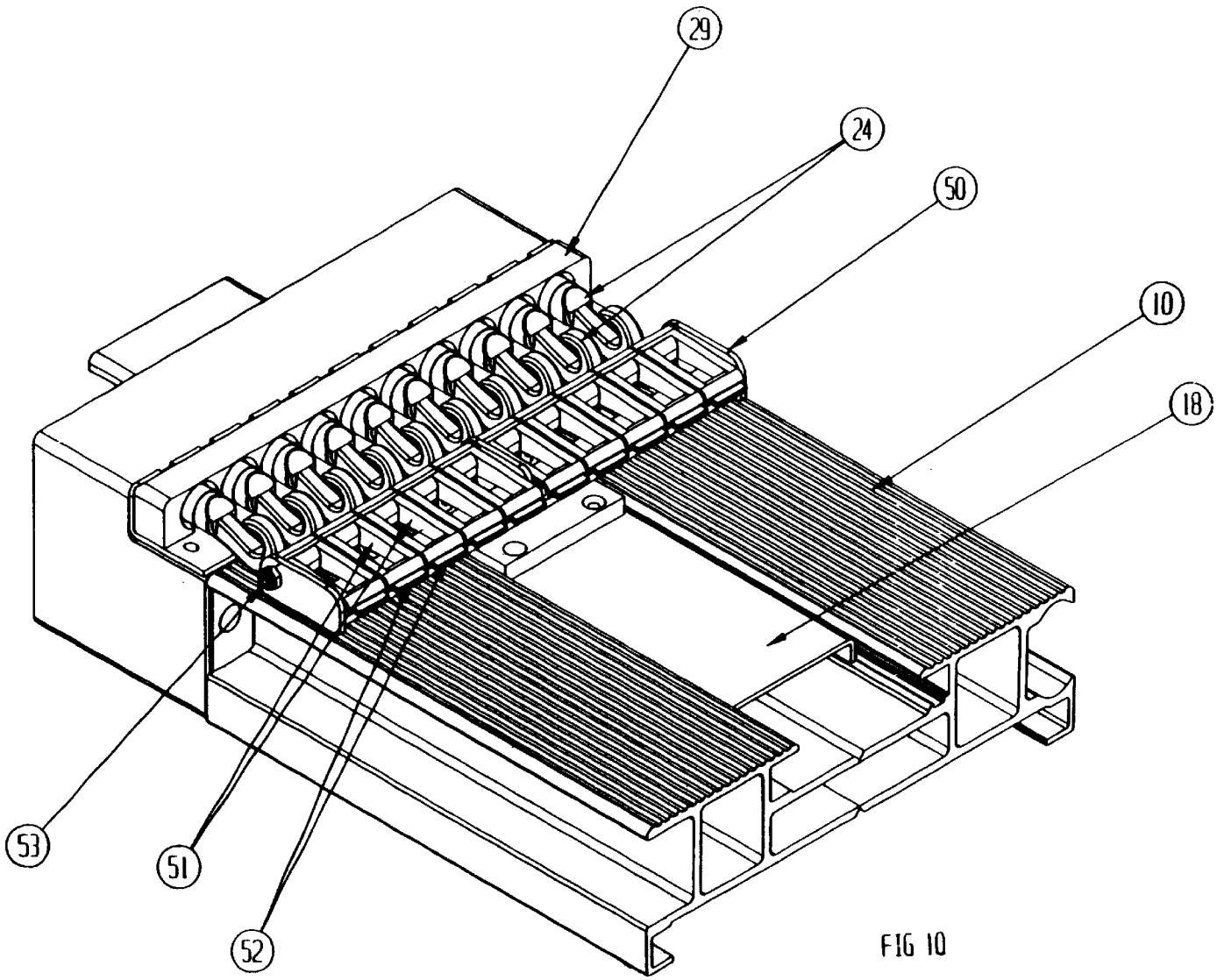
FIG. 10 is a perspective view of a portion of the base in accordance with a further embodiment of the invention, but with the hooks disengaged and the cords relaxed.

FIG. 10 shows a partial view of the base in the area where the bungee cord hooks 24 are resting in the stop block 29. In this embodiment, the hook mounting bracket 31 is replaced by the latch mounting bracket 50. This is attached to the seat slide rack 18. The latches 51 are rotatably mounted to the latch mounting bracket 50 via a pivot shaft 53. The latches 51 have a tab 52 projecting from the free end and are injection molded plastic or other suitable material. When the user wants to attach a bungee cord, they place their finger or toe of their foot beneath the tab 52 and flip the latch 51 over so it rotates around to engage the hook 24. See FIG. 11. In this manner, the bungee cord hooks 24 become attached to the seat slide rack 18.

Figure 11:
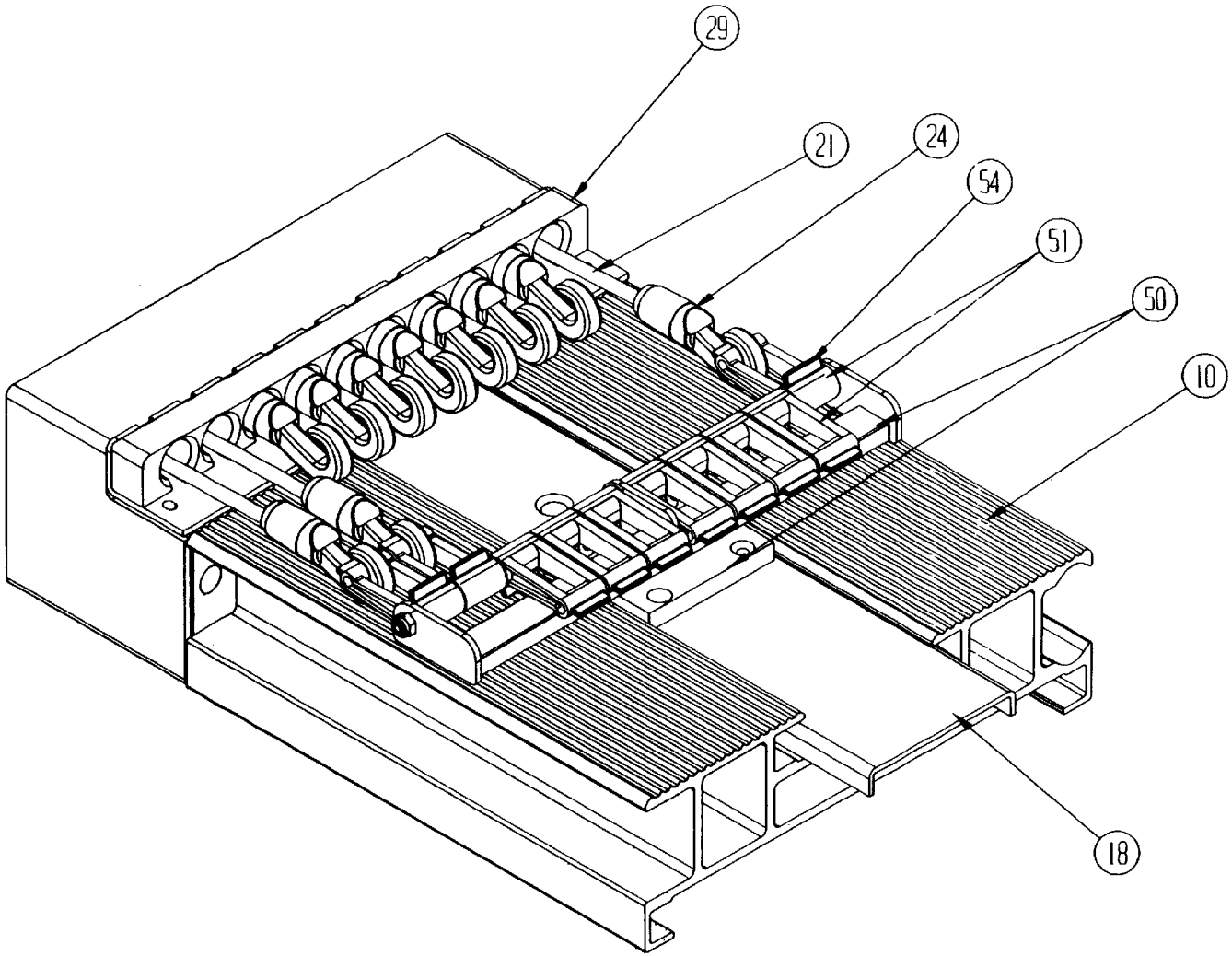
FIG. 11 is the same view as in FIG. 10, but with some of the hooks engaged and the associated cords under tension.

FIG. 11 shows the seat slide rack 18 pulled back. A suitable number of bungee cords 21 have been attached to the latch mounting bracket 50 using the latches 52 pivoted over to engage the hooks 24. A second tab 54 is part of the underside of the latch. When the seat slide rack 18 is forward and locked in place, the second tabs 54 may be used to flip the latches 51 back around so they do not engage the hooks.

In all the embodiments, stops may be provided that block the seat slide rack 18 from sliding relative to the base outside of a range. The stops are attached to the base and bear the full load against it if the user stops exerting a force against the load applied by the elastic cords or overcomes the load with too much force.

It logically follows that the user is performing more metabolic work when pedaling an ergometer and supporting an additional steady load even if the user is not performing additional mechanical work. Metabolic work rates are well known for standard ergometers at various mechanical work rates performed at the pedals. The pedal work measured in watts does not convert equally to calories burned or metabolic units of the user. The equations for these metabolic work rates corresponding to mechanical work rates have been long established via oxygen uptake studies on people for various types of ergometers.

A study was performed to quantify and derive equations for the metabolic work rates for the various loads from the elastic cords at various mechanical pedal work rates for the Cyclocentric Semi Recumbent Ergometer. To put this into effect, the user simply has to enter the number of cords hooked to the seat into the display controller. This way the proper work rates are displayed. Another important aspect of this is when the ergometers are set to provide a constant work rate. If a set rate is desired, a portion will occur because of the elastic cord load so the mechanical work rate of the pedals can be adjusted to give the total work rate desired. This is very important in cardiac and other rehabilitation programs.

The base 10 and the frame 22 may be considered as being the same component or separate components. If separate, they are attached to each other and may be treated as a unified structure.

When used in the claims, the term "base" refers to either the base 10, the frame 22, or a composite structure in which both the base 10 and frame 22 are attached or integrally formed with each other so as to be considered the same component.

Although the seat unit 7 is depicted as a chair with a back rest. and a seat, the chair may be replaced by a stool or a padded post to lean against. The padded portion of the post may be considered to be a seat, although the user will merely be resting their backside against it, not sitting upon it.

Although the present invention has been described in relation to a particular embodiment, many other variations and modifications and other uses may become apparent to those skilled in the art.

It is preferred, therefore, that the present invention be limited not by this specific disclosure herein, but only by the appended claims.

What is claimed is:

1. A method of moving a seat unit back and forth while pedaling, comprising:

adjusting the position of a seat unit and connecting the seat unit to a seat slide rack that is arranged to slide back and forth relative to a base so that the seat unit slides in unison with the seat slide rack back or forth in dependence upon a direction that a load is applied to the seat slide rack;

setting the load to be applied to the seat slide rack;

applying the load to the seat slide rack to push or pull the seat slide rack to slide back or forth depending upon the direction that the load is applied to the seat slide rack, the applying including confining an extent to which the seat slide rack may slide back or forth by using elastic cords to effect the applying of the load; and pedaling while sitting on the seat unit and while the load is applied to the seat slide rack.

2. A method as in claim 1, wherein the seat unit includes a seat, a pedestal and a platform, the pedestal being arranged between the seat and the platform and being attached to the seat and the platform, the platform being slidably attached to the base to slide back and forth along the seat slide rack in response to forces of the load applied to the seat slide rack.

3. A method as in claim 2, wherein the connecting includes releasably locking the seat slide rack and the seat unit together so that when locked into a locking position, the seat slide rack and the seat unit are movable in unison together relative to the base and when released from the locking position, the seat slide rack and the seat unit are movable independent of each other relative to the base so a position of the seat unit can be set; and releasably locking the seat slide rack to the base so that when the seat slide rack is locked to the base in a locked position, no relative movement may occur between the seat slide rack and the base, and when the seat slide rack is released from locked position, relative movement may occur between the seat slide rack and the base.

4. A method as in claim 3, further comprising:

securing the elastic cords in position to effect the setting of the load while the seat slide rack is in the locked position so that the elastic cords may exert the load on the seat slide rack when the seat slide rack is released from the locked position to confine a distance between which the seat slide rack may travel back and forth relative to the base.

5. A method as in claim 2, further comprising a mounting bracket, a further bracket, pulleys and a frame, the securing of the elastic cords including attaching an end of the cords to the mounting bracket while the seat slide rack is in the locked position, the mounting bracket being attached to the seat slide rack, the elastic cords being wrapped around the pulleys and being attached at a further end to the further bracket, the pulleys having respective axes that are attached to one of the base and the frame, the further bracket being attached to one of the seat slide rack, the base and the frame, the base and the frame being connected to each other.

6. A method as in claim 5, wherein the elastic cords are attached to the further bracket and wrapped around further pulleys whose axial centers are connected to one of the base and the frame.

7. A method as in claim 2, wherein the pedaling is with a pedal and crank assembly that is located at an elevation equal to or lower than that of the seat.

8. A method as in claim 2, wherein the pedaling is with arm grip and crank assembly that is located at an elevation higher than that of the seat.

9. A method as in claim 5, further comprising an adjustment mechanism that secures the further end of the elastic cords to the one of the seat slide rack and the base.

10. A method as in claim 9, wherein the adjustment mechanism includes a component that is fixed into one of a plurality of relative positions with respect to the base so that when the further ends of the elastic cords are attached to the further bracket, a relative position of the further ends with respect to the base is dependent upon a relative position at which the component is fixed.

11. A method as in claim 2, wherein the pedaling is with rotary elements mounted to a mechanism within a housing that is supported by the base.

12. A method as in claim 2, further comprising swiveling the seat.

13. A method as in claim 1, wherein the setting includes connecting a plurality of the elastic cords to a mounting bracket that is attached to the seat unit.

14. A method as in claim 13, further comprising tensioning the elastic cords that are connected.

15. A method as in claim 1, wherein the confining also includes arranging stops in a path that the seat slide rack travels to block the seat slide rack from moving past the stops.

16. A method as in claim 13, wherein the connecting includes pivoting latches to engage hooks at ends of the elastic cords.

17. An apparatus to move a seat unit back and forth while pedaling, comprising:

a seat slide rack that is arranged to slide back and forth relative to a base so that the seat slide rack slides back or forth in dependence upon a direction that a load is applied to the seat slide rack;

a seat unit;

means for connecting the seat unit to the seat slide rack so that the seat unit may be adjusted to a position and for then connecting the seat unit so that it is movable in unison with the seat slide rack;

means for setting the load to be applied to the seat slide rack;

means for applying the load to the seat slide rack to push or pull the seat slide rack to slide back or forth depending upon the direction that the load is applied to the seat slide rack, said means for applying including means for confining an extent to which the seat slide rack may slide back or forth, the means for confining including elastic cords arranged to apply the load to the seat slide rack; and means for pedaling while sitting on the seat unit and while the load is applied to the seat slide rack.

18. An apparatus as in claim 17, wherein the seat unit includes a seat, a pedestal and a platform, the pedestal being arranged between the seat and the platform and being attached to the seat and the platform, the platform being slidably attached to the base to slide back and forth along the seat slide rack in response to forces applied to the seat slide rack.

19. An apparatus as in claim 18, wherein said means for connecting includes means for releasably locking the seat slide rack and the seat unit together so that when locked into a locking position, the seat slide rack and the seat unit are movable in unison together relative to the base and when released from the locking position, the seat slide rack and the seat unit are movable independent of each other relative to the base; and means for releasably locking the seat slide rack to the base so that when the seat slide rack is locked to the base in a locked position, no relative movement may occur between the seat slide rack and the base, and when the seat slide rack is released from locked position, relative movement may occur between the seat slide rack and the base.

20. An apparatus as in claim 19, further comprising:

means for securing the elastic cords in position to effect the setting of the load while the seat slide rack is in the locked position so that the elastic cords may exert the load on the seat slide rack when the seat slide rack is released from the locked position to confine a distance between which the seat slide rack may travel back and forth relative to the base.

21. An apparatus as in claim 18, further comprising a frame, the means for securing elastic cords including means for attaching an end of the cords to a mounting bracket while the seat slide rack is in the locked position, the mounting bracket being attached to the seat slide rack, the elastic cords being wrapped around pulleys and being attached at a further end to a further bracket, the pulleys having respective axes that are attached to one of the base and the frame, the further bracket being attached to one of the seat slide rack, the base and the frame, the base and the frame being in connection with each other.

22. An apparatus as in claim 21, wherein the elastic cords are attached to the further bracket and wrapped around further pulleys whose axial centers are connected to one of the base and the frame.

23. An apparatus as in claim 18, wherein the means for pedaling includes a pedal and crank assembly that is located at an elevation equal to or lower than that of the seat.

24. An apparatus as in claim 18, wherein the means for pedaling includes arm grip and crank assembly that is located at an elevation higher than that of the seat.

25. An apparatus as in claim 21, further comprising an adjustment mechanism that is arranged to secure the further end of the elastic cords to the one of the seat slide rack and the base.

26. An apparatus as in claim 25, wherein the adjustment mechanism includes a component that is fixed into one of a plurality of relative positions with respect to the base so that when the further ends of the elastic cords are attached to the further bracket, a relative position of the further ends with respect to the base is dependent upon a relative position at which the component is fixed.

27. An apparatus as in claim 26, wherein the pedaling means includes rotary elements that are mounted to a mechanism within a housing that is attached to one of the frame and the base.

28. An apparatus as in claim 18, further comprising means for swiveling the seat.

29. An apparatus as in claim 20, further comprising latches that are pivoted to swing about a pivot to engage hooks at ends of the elastic cords.

30. An apparatus as in claim 17, wherein said confining means includes stops arranged in a path of the seat slide rack to block the seat slide rack from passing the stops.

31. An apparatus to move a seat unit back and forth while pedaling, comprising:

a seat unit;

a seat slide rack that is arranged to slide back and forth relative to a base in dependence upon a direction that a load is applied to the seat unit;

a connector arranged to connect the seat unit to the seat slide rack and so that the seat unit may be adjusted to a position;

a setting mechanism configured to set the load to be applied to the seat slide rack;

a load applying mechanism configured to apply the load to the seat slide rack to push or pull the seat slide rack to slide back or forth depending upon the direction that the load is applied to the seat slide rack, the load applying mechanism including a confining mechanism arranged to confine an extent to which the seat slide rack may slide and means for pedaling while sitting on the seat and while the load is applied to the seat slide rack.

32. An apparatus as in claim 31, wherein the seat unit includes a seat, a pedestal and a platform, the pedestal being arranged between the seat and the platform and being attached to the seat and the platform, the platform being slidably attached to the base to slide back and forth along the seat slide rack in response to forces applied to the seat slide rack.

33. An apparatus as in claim 32, wherein the connector includes a releasably locking mechanism arranged to releasably lock the seat slide rack and the seat unit together so that when locked into a locking position, the seat slide rack and the seat unit are movable in unison together relative to the base and when released from the locking position, the seat slide rack and the seat unit are movable independent of each other relative to the base; and a further releasably locking mechanism arranged to releasably lock the seat slide rack to the base so that when the seat slide rack is locked to the base in a locked position, no relative movement may occur between the seat slide rack and the base, and when the seat slide rack is released from locked position, relative movement may occur between the seat slide rack and the base.

34. An apparatus as in claim 33, further comprising:

securing mechanism arranged to secure the elastic cords in position to effect the setting of the load while the seat slide rack is in the locked position so that the elastic cords may exert the load on the seat slide rack when the seat slide rack is released from the locked position to confine a distance between which the seat slide rack may travel back and forth relative to the base.

35. An apparatus as in claim 34, further comprising a mounting bracket, a further bracket, pulleys and a frame, the securing mechanism including an attaching mechanism configured to attach an end of the cords to a mounting bracket while the seat slide rack is in the locked position, the mounting bracket being attached to the seat slide rack, the elastic cords being wrapped around the pulleys and being attached at a further end to the further bracket, the pulleys having respective axes that are attached to one of the base and the frame, the further bracket being attached to one of the seat slide rack, the base and the frame, the frame and the base being connected to each other.

36. An apparatus as in claim 35, wherein the elastic cords are attached to the further bracket and wrapped around further pulleys whose axial centers are connected to one of the base and the frame.

37. An apparatus as in claim 32, wherein the means for pedaling includes a pedal and crank assembly that is located at an elevation equal to or lower than that of the seat.

38. An apparatus as in claim 32, wherein the means for pedaling includes arm grip and crank assembly that is located at an elevation higher than that of the seat.

39. An apparatus as in claim 35, further comprising an adjustment mechanism that is arranged to secure the further end of the elastic cords to the one of the seat slide rack and the base.

40. An apparatus as in claim 39, wherein the adjustment mechanism includes a component that is fixed into one of a plurality of relative positions with respect to the base so that when the further ends of the elastic cords are attached to the further bracket, a relative position of the further ends with respect to the base is dependent upon a relative position at which the component is fixed.

41. An apparatus as in claim 40, wherein the pedaling means includes rotary elements that are mounted to a mechanism within a housing that is attached to one of the frame and the base.

42. An apparatus as in claim 32, wherein the pedestal and the platform are configured and arranged to permit swiveling of the seat relative to the platform.

43. An apparatus as in claim 34, further comprising latches that are pivoted to swing about a pivot to engage hooks at ends of the elastic cords.

44. An apparatus as in claim 31, further comprising stops arranged in a path of the seat slide rack to block the seat slide rack from passing beyond the stops.

* * * * *